US005606841A

United States Patent [19]

Carter, Jr.

[11] Patent Number: 5,606,841

[45] Date of Patent: Mar. 4, 1997

[54] FILLED INTERIOR WALL PANELS

[76] Inventor: Morris Carter, Jr., Rte. 2, Box 2125, Starke, Fla. 32091

[21] Appl. No.: 428,712

[22] Filed: Apr. 25, 1995

[51] Int. Cl.[6] ..... E04C 2/34

[52] U.S. Cl. ..... 52/802.1; 52/311.2; 52/316; 52/792.1; 52/794.1

[58] Field of Search ..... 52/311.1, 311.2, 52/315, 316, 792.1, 794.1, 801.1, 802.1

[56] References Cited

U.S. PATENT DOCUMENTS

| | | | |
|---|---|---|---|
| 134,300 | 12/1872 | Mellen | 52/311.1 |
| 583,713 | 6/1897 | Russell | 52/794.1 X |
| 1,776,610 | 9/1930 | Andrews | 52/794.1 X |
| 2,271,355 | 1/1942 | Sweet | 52/794.1 X |
| 2,312,987 | 3/1943 | Grassick | 52/794.1 X |
| 3,032,150 | 5/1962 | Herbert, Jr. | 52/794.1 X |
| 3,147,336 | 9/1964 | Mathews | 52/794.1 X |
| 3,418,766 | 12/1968 | Jackson | 52/311.1 |
| 3,706,171 | 12/1972 | Shayman | 52/801.1 X |
| 4,420,922 | 12/1983 | Wilson | 52/792.1 X |
| 4,694,624 | 9/1987 | Juhas | 52/794.1 X |
| 4,724,638 | 2/1988 | Bezborodko | 52/311.1 X |

FOREIGN PATENT DOCUMENTS

| | | | |
|---|---|---|---|
| 530912 | 1/1922 | France | 52/801.1 |
| 416792 | 7/1947 | Italy | 52/801.1 |
| 292437 | 12/1990 | Japan | 52/794.1 |
| 267453 | 11/1991 | Japan | 52/311.1 |
| 267452 | 11/1991 | Japan | 52/311.1 |
| 357530 | 3/1960 | Switzerland | 52/316 |

*Primary Examiner*—Wynn E. Wood
*Assistant Examiner*—Aimee E. McTigue
*Attorney, Agent, or Firm*—Dowell & Dowell

[57] ABSTRACT

Interior wall panels having a rigid frame backing member to which an outer pliable sheet material is secured. A filling or padding material is retained between the sheet material and the backing member and the sheet material is secured through the filling in a plurality of spaced locations to thereby create a three dimensional surface relief. In some embodiments, the wall panels may be specifically constructed to provide thermal and sound insulating properties.

14 Claims, 3 Drawing Sheets

Fig. 6
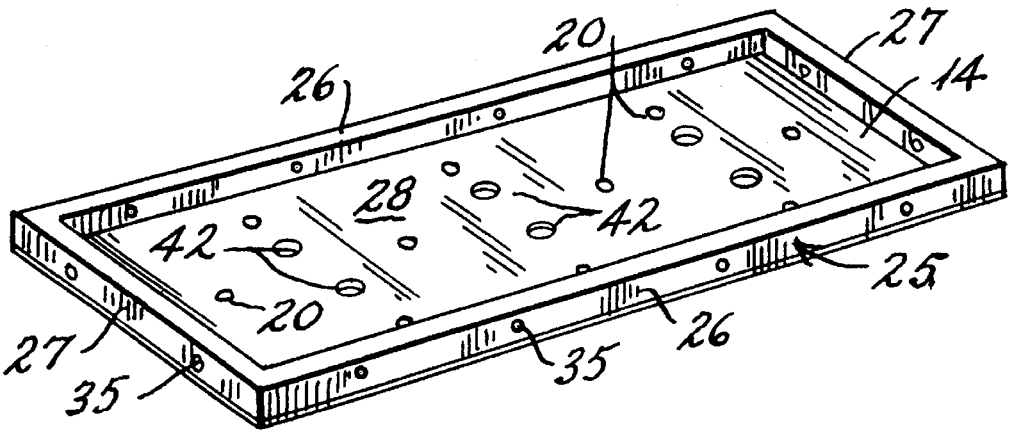
Fig. 7
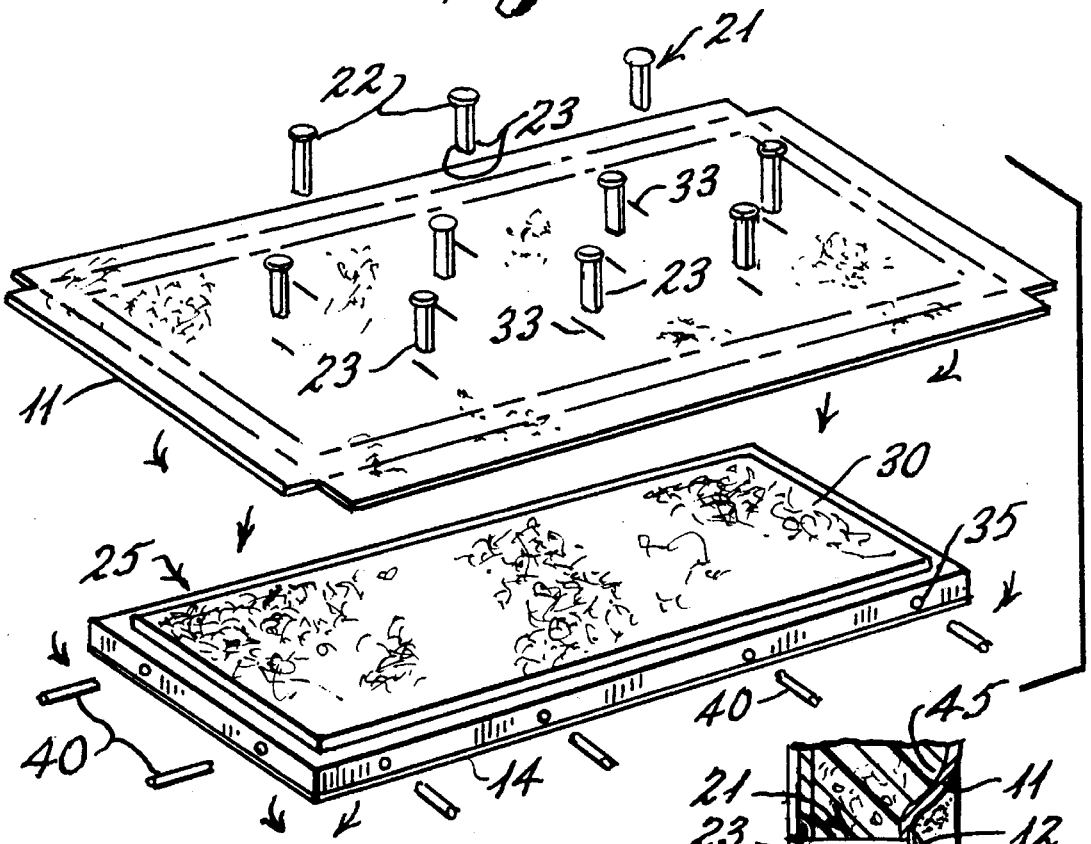
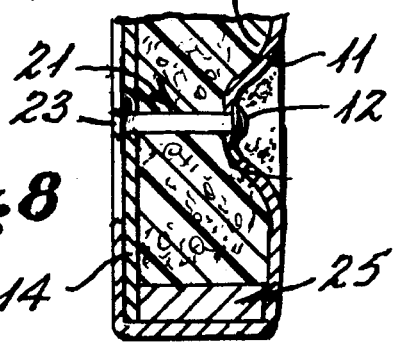
Fig. 8

FILLED INTERIOR WALL PANELS

BACKGROUND OF THE INVENTION

1. Field of the Invention

This invention is generally directed to interior wall panelling and more specifically to padded wall panels which are tufted so as to create three dimensional surface reliefs. The panels of the present invention may also be specifically designed to provide thermal as well as sound insulation and may be filled with a conventional heat insulating material whereby the panels become multi-functional and cost effective, especially in areas where insufficient wall insulation has not been provided.

2. History of the Related Art

Numerous types and styles of wall panels have been utilized to accent and decorate the interiors of homes, offices and other buildings. Most wall panelling, however, is not constructed to provide a great deal of visual relief with the exceptions of surface shading, patterns, and grooves.

Conventional panelling is normally constructed of wood fiber materials which are formed into sheets and covered with a surface veneer. The panelling is applied to existing drywall surfaces by adhering the panelling to the wall. In some instances, panelling is made substantially more durable so that the panelling itself may be secured directly to a sub-structural, such as wall studding.

Many interior decorators and building contractors utilize various moldings over panelled walls to further accentuate the surface characteristics of the panelling. Unfortunately, molding is relatively expensive and must be applied after the panelling has been installed.

Therefore, the prior art has not recognized the need to provide interior wall panelling wherein the surface of the panelling, itself, provides three dimensional relief. In the furniture industry, three dimensional relief of surface characteristics is obtained by utilizing padding which fills the area between the frame of the furniture and the furniture cover. In many instances, the furniture cover is secured through the padding material to the frame, such as by utilizing tufting anchors with tufting buttons. Although the three dimensional relief obtained in the furniture industry has been utilized over a long period of time, the characteristics obtained by this type of construction has not been recognized as being suitable for interior wall decorating. Such surface relief, however, has been recognized and used in other industries, such as in the automotive industry wherein tufted fabrics, leathers, and imitation leathers are utilized to create a three dimensional luxurious appearance in the interior of a vehicle.

Conventional panelling is normally provided for the specific use of creating a pleasing visual effect to a wall surface but generally does not provide any sound abating or thermal insulating properties. If panelling is utilized to cover an unfinished wall, it is frequently necessary to install conventional insulating materials to the walls before the panelling is installed. This is especially true when panelling is secured directly to the substructure of a building as opposed to being applied to a wall surface.

SUMMARY OF THE INVENTION

The present invention is directed to interior wall panels which are specifically designed to present a three dimensional surface relief and which include various fabric, leather, or imitation leather surface coverings. Each panel includes a rigid backing member which is preferably formed of a plywood material to which a frame is secured so as to extend forwardly therefrom. The volume defined by the frame and the backing member is filled with a padding material, such as a resilient foam, natural and artificial fibers, such as fibers batting, or other relatively resilient or yieldable plastic and rubber materials. A surface sheet material is placed over the padding material and about the frame and secured to the rear portion of the backing member. Thereafter, a plurality of tufting anchors are inserted through the cover or surface sheet and the backing layer, afterwhich tufting buttons are applied thereto, to thereby contour the cover to create a deep three dimensional relief.

The panels are preferably designed to be connected to one another. A plurality of openings are made along the edges of the frames into which dowel rods or pins are selectively inserted to thereby connect one panel to an adjacent panel.

The tufted interior wall panels of the present invention may be manufactured in various conventional sizes, so as to be utilized as conventional panelling would be and applied either directly over an existing wall surface or to sub-surface studding. In addition, the panelling may be utilized to create independent surface relief by applying single panels over an existing wall surface.

The present invention may be utilized not only to provide a unique surface characteristic, but to provide both sound and thermal insulation. The material which is utilized for stuffing or padding the panels may be a conventional insulating material, such as a glass fiber material. To further provide for good thermal insulation, in some embodiments, a radiant energy reflecting layer, such as an aluminum foil layer, is provided intermediate the covering material and the reinforced backing member to thereby reduce radiant energy heat loss through the panelling. When the panelling is constructed for use as a thermal insulating material, spaced openings may be provided through the backing member thereby allowing the interior of the panel to breathe in communication with the wall space between adjacent studs of the supporting substructure.

It is the primary object of the present invention to provide interior wall panelling having an exterior surface formed of a fabric, leather or leather-like material which, in the preferred embodiment, is tufted to a reinforcing backing member to create a three dimensional relief for the surface of the panelling.

It is a further object of the present invention to provide wall panelling which not only presents a luxurious surface appearance but which also may function as a thermal insulating barrier and a sound insulating barrier.

It is another object of the present invention to provide interior wall panelling which can be utilized in place of conventional insulating materials so that a non-insulated wall can be simultaneously insulated and covered with a finished surface appearance having a highly visual three dimensional relief and wherein the energy savings obtained by installing the panels will make the panels economically efficient for practical use.

It is yet another object of the present invention to provide interior wall panelling having a fabric or other flexible material surface covering which can be easily replaced if the material becomes damaged or worn or wherein the panelling may be recovered with a different material in order to obtain a different visual effect.

It is yet another object of the present invention to provide an insulated interior wall panel which permits an individual to simultaneously cover and insulate a wall without having to directly handle the insulating materials.

BRIEF DESCRIPTION OF THE DRAWINGS

FIG. 6 is a front perspective view of the backing member and frame component of the panelling shown in FIG. 3.

FIG. 7 is an assembly view showing the covering sheet, filling or stuffing and framed backing member of the panelling shown in FIG. 3

FIG. 8 is an enlarged cross-sectional view taken along line 8—8 of FIG. 3 showing a radiant energy reflective layer mounted between the covering sheet and the panel member.

DESCRIPTION OF THE PREFERRED EMBODIMENT

Figure 1:
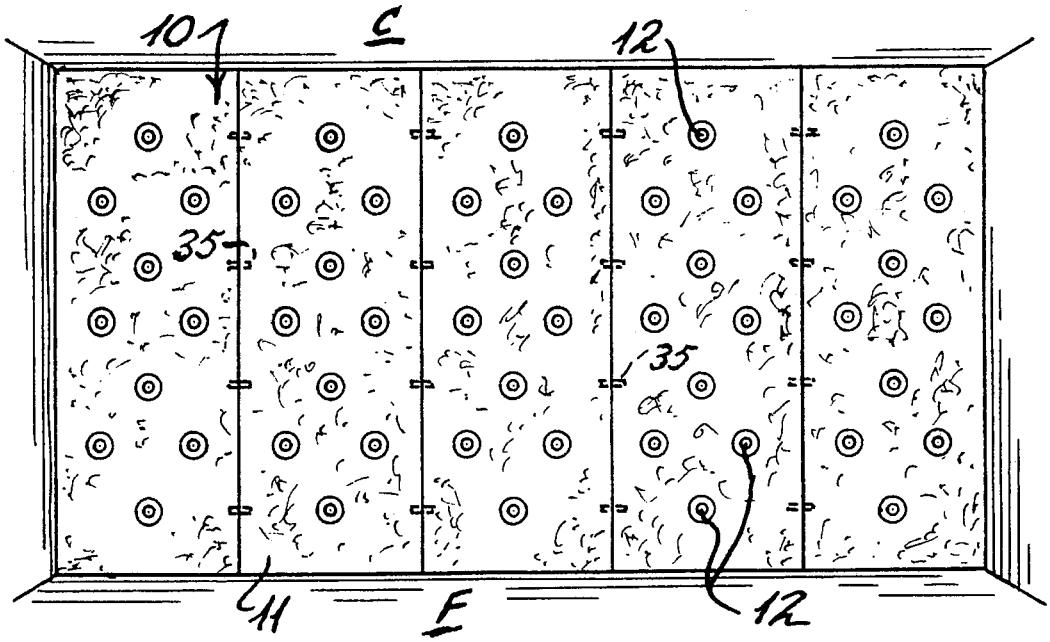
FIG. 1 is a front perspective view illustrating a plurality of panels constructed in accordance with the teachings of the present invention mounted across one wall of a room and extending between the floor and the ceiling.

With continued reference to the drawing figures, in FIG. 1, a plurality of panels constructed in accordance with the teachings of the present invention are shown as being installed covering the entire wall of a room. The panels 10 are shown as extending between the floor "F" and the ceiling "C" and are therefore approximately seven to eight feet in height and approximately up to two to three feet in width with two feet being preferred. If the panels are longer they become too bulky and heavy to easily handle. In a preferred embodiment, the panels are constructed so as to be secured to conventional studding which is normally spaced on sixteen or twenty-four inch centers so that the panels may be secured directly to interior wall studs as well as being secured in overlying relationship with respect to finished drywall surfaces.

Figure 2:
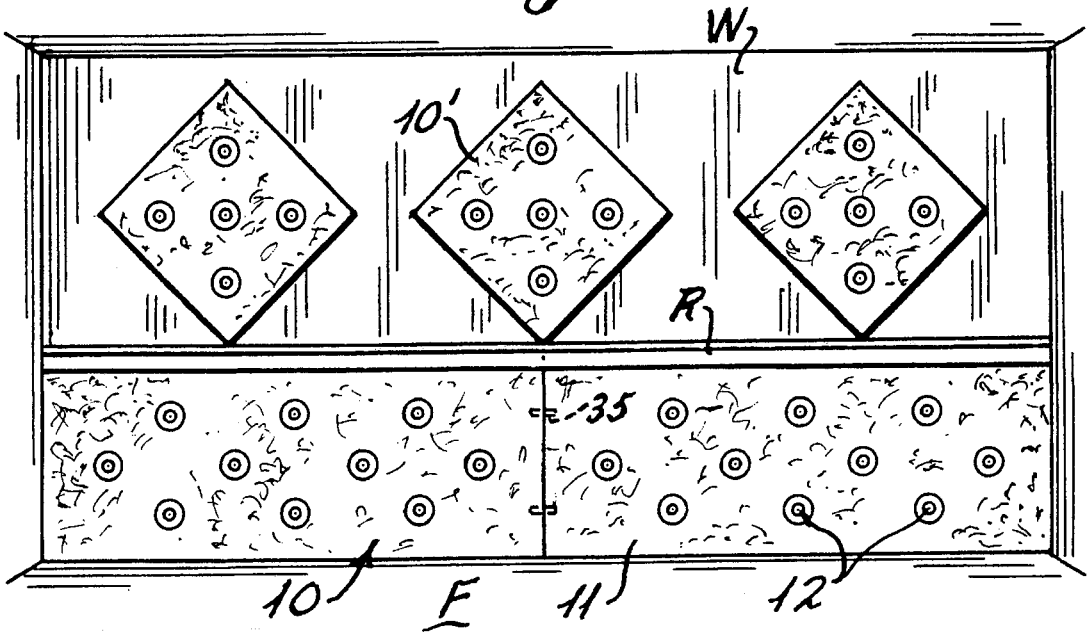
FIG. 2 is a view similar to FIG. 1 showing the panelling of the present invention installed in a different configuration against one wall of a room.
Figure 3:
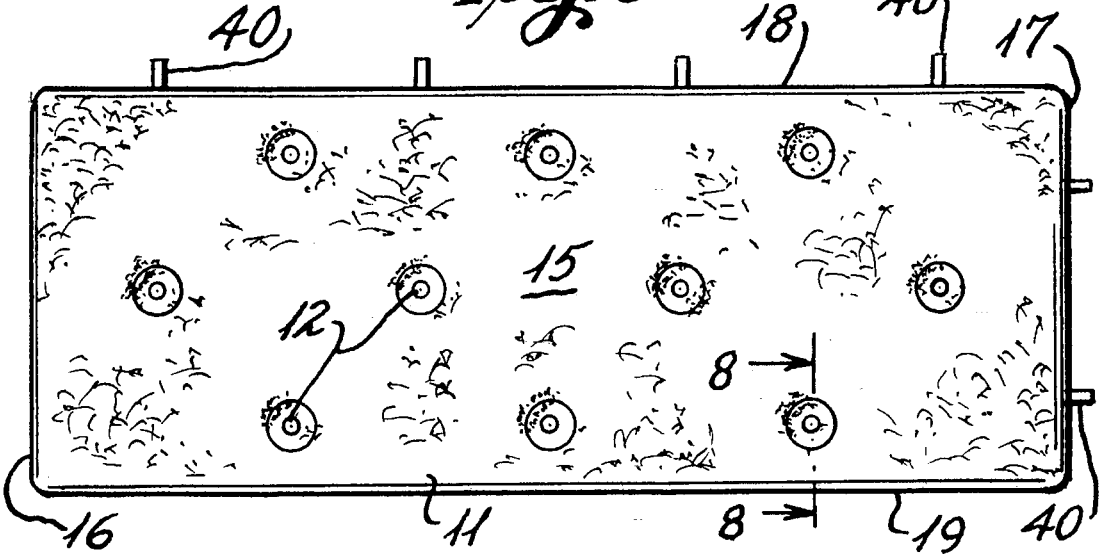
FIG. 3 is a front plan view of one embodiment of panelling constructed in accordance with the teachings of the present invention.

In FIG. 2, two panels are being shown mounted below a chair rail "R" with variations of the wall panels of FIG. 1 being directly mounted to a finished wall surface to provide a unique visual relief. As shown in the embodiment of FIGS. 1 and 2, a three dimensional relief is created in the outer surface material 11 by providing a plurality of tufting buttons 12 which are secured through the covering material to a rigid backing member 14. Each panel includes a front surface 15 opposite ends 16 and 17 and elongated sides 18 and 19. The three dimensional characteristics created by the tufting of the surface 15 may be varied by changing the pattern and number of tufting buttons 12 used in each panel. In some instances, the panels across a given wall will have different tufting patterns associated therewith and in some panels the tufting may be excluded, although this is not preferred. Although, the preferred embodiment is shown having rectangular panels, different shapes of panels may be provided. In FIG. 2, the panels 10' are shown as being generally square in configuration.

Figure 4:
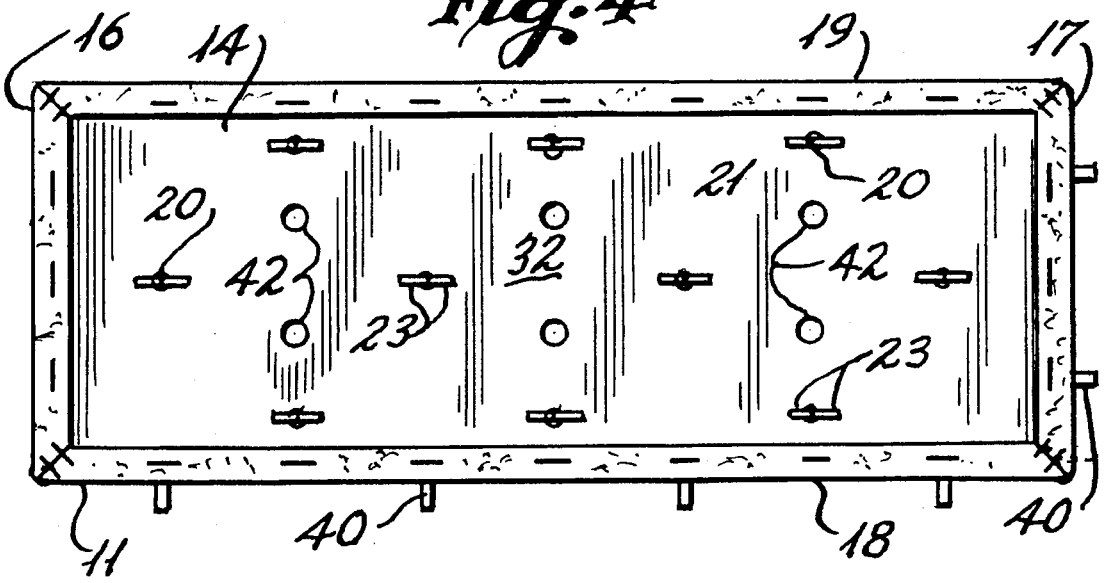
FIG. 4 a rear view of the panelling shown in FIG. 3.

With particular reference to FIGS. 6 and 7, the structure of the panels will be described in greater detail. The rigid backing layer 14 is preferably constructed of a plywood material of one-half to three-quarter inch thickness. In some instances, pressed wood or other types of heavy duty fiber board may be utilized. A plurality of first openings 20 are provided through the backing member 14 which are spaced in a predetermined pattern depending upon the tufting configuration desired for the outer surface 15. The openings 20 receive anchoring elements 21 having enlarged head portions 22 to which the tufting buttons 12 are forced fitted in a conventional manner. Each anchoring element 21 also has a pair of legs 23 which may be bent outwardly relative to one another, as shown in FIG. 4, after the elements have been positioned through the backing member 14 to thereby secure the pins in assembled relationship with respect to the backing member. Prior to installing the anchoring elements 21, a frame 25 is secured, such as by an adhesive, about the periphery of the backing member 14. In the preferred embodiment, the frame is formed of a one-inch-by-one-inch wood material consisting of two elongated side elements 26 and opposite ends 27 which are mitered together at their ends. The frame is mounted to the backing member so as to extend upwardly from the front surface 28 of the backing member and thereby defines a volume in which a stuffing material 30 maybe positioned.

The stuffing or filling material 30 may vary depending upon a particular panel. In some embodiments, the filling material may be a fibrous batting material of either natural or synthetic fibers. In other embodiments, the filling material may be a resilient foam or sponge rubber or other similar material. It is preferred that whatever material is used be treated so as to be fire retardant. As previously discussed, the material may also be a thermal insulating material of a conventional type and may be either blown into the area defined by the frame or may be placed in sheets within the area. It is preferred that the material be placed so as to fill the volume defined by the frame and extend outwardly above the frame, as shown in FIG. 7, before the cover 11 is applied.

Once the filling has been placed, the cover 11 which is of a size so as to extend around the frame and to the rear of the backing member 14, as shown in FIG. 4, is placed in overlying relationship to the frame. Thereafter the cover is pulled tight and secured by staples or other conventional fasteners to the rear surface 32 of the backing member 14.

A plurality of spaced slits 33 are preferably provided in the covering material 11 so as to be in aligned relationship with the openings 20 formed in the backing sheet. Once the covering material has been secured to the backing member 14, the pin elements 21 are inserted through the slits 33, through the filling 30 and the openings 20 and thereafter the legs 23 spread to prevent the pins from being withdrawn from the openings. Once the pins have been installed, the tufting buttons may be secured to the enlarged heads 22 thereof.

Figure 5:
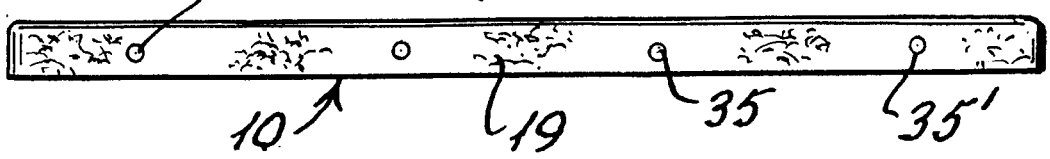
FIG. 5 is a side elevational view of the panelling shown in FIG. 3.

In the preferred embodiment, the panels are securable with respect to one another. To this end, a plurality of spaced holes 35 are provided in the sidewalls of the frame elements 26 and 27, as is shown in FIG. 6. After the covering material 11 has been secured to the backing member, aligned openings 35' are made through the covering material so as to align with the holes 35, as shown generally in FIG. 5. To connect the panels together, a plurality of dowel pins 40 are provided of a size to be securely and frictionally received within the holes 35. When the panels are mounted together, the pins will connect the panels, as shown by the dotted line installation of the pins in FIGS. 1 and 2.

When the panels of the present invention are being specifically designed to provide a good thermal insulating properties, it may be necessary to provide additional openings 42 through the backing member 14 to allow air to circulate into the interior of the panel so as to prevent condensation within the interior after the panel has been installed. To provide for radiant thermal protection, and as shown in FIG. 8, a radiant energy reflecting layer 45 may be positioned intermediate the covering material 11 and the filling 30.

The covering material 11 may be any suitable fabric or may also be a leather, artificial leather or vinyl depending upon the desired interior wall effect to be created. In the event that a surface material should become damaged or worn for any reason, it is relatively easy to remove the panels and replace the covering material without having to go through the expense of replacing the backing member, the frame, or the filling material. In many instances, if it is desired to change the surface appearance of the panel, a second fabric material may be applied directly over the existing material.

From the foregoing, it is apparent that the panels of the present invention provide a unique utility for interior wall finishing which is heretofore not been possible utilizing conventional panelling and wall coverings. The present invention not only allows for surface characteristics to be changed relatively easy without significant cost, but the three dimensional relief created by the wall panels is unique with respect to conventional wall treatments. Further, the present invention provides for both thermal and sound installation qualities which are not found in conventional wall panelling and other wall treatments and thus provides a unique system which will pay for itself in energy savings in a relatively short period of time.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims, and their equivalents.

I claim:

1. An interior wall panel comprising, a substantially continuous rigid backing member having opposite ends and opposite side edges and front and rear surfaces, a frame extending from said front surface of said backing member adjacent each of said opposite ends and side edges, a filling material positioned within said frame and on said front surface of said backing member, a plurality of spaced openings in said backing member extending between said front and rear surfaces thereof, a flexible covering material extending over said filling material and said frame, securing means for securing said covering material relative to said backing member and said securing means including tufting means for creating a three-dimensional relief for said covering material.

2. The interior wall panel of claim 1 in which said tufting means includes a plurality of anchoring pins extending through said covering material, said filling material and through said spaced openings, each of said anchoring pins having an enlarged head, and a tufting button secured to said enlarged head of each of said anchoring pins so as to be in overlying relationship with respect to said covering material.

3. The interior wall panel of claim 2 in which said frame includes side edges, a plurality of spaced openings in said side edges, and pin means for extending into said side openings whereby interior wall panels may be connected by said pin means with one another.

4. The interior wall panel of claim 2 including a plurality of second openings in said backing member and extending between said front and rear surfaces thereof for allowing air to circulate into said filling material between said backing member and said covering material.

5. The interior wall panel of claim 4 in which said filling material is a thermal insulating material.

6. The interior wall panel of claim 4 including a radiant energy reflecting material mounted intermediate said covering material and said backing member.

7. The interior wall panel of claim 6 in which said filling material is a thermal insulating material.

8. The interior wall panel of claim 4 in which said filling material is fire retardant.

9. The interior wall panel of claim 2 in which said filling material is fire retardant.

10. The interior wall panel of claim 1 in which said frame includes side edges, a plurality of spaced openings in said side edges, and pin means for extending into said side openings whereby interior wall panels may be connected by said pin means one another.

11. The interior wall panel of claim 1 including a plurality of second openings in said backing member and extending between said front and rear surfaces thereof for allowing air to circulate into said filling material between said backing member and said covering material.

12. The interior wall panel of claim 11 in which said filling material is a thermal insulating material.

13. The interior wall panel of claim 12 including a radiant energy reflecting material mounted intermediate said covering material and said backing member.

14. The interior wall panel of claim 1 in which said filling material is fire retardant.

* * * * *